US007477861B2

(12) United States Patent
Taira

(10) Patent No.: US 7,477,861 B2
(45) Date of Patent: Jan. 13, 2009

(54) TEMPERATURE CONTROL DEVICE AND IMAGE FORMING APPARATUS

(75) Inventor: Masayoshi Taira, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 11/696,968

(22) Filed: Apr. 5, 2007

(65) Prior Publication Data

US 2007/0248371 A1 Oct. 25, 2007

(30) Foreign Application Priority Data

Apr. 20, 2006 (JP) ..... 2006-116593

(51) Int. Cl.
*G03G 15/20* (2006.01)

(52) U.S. Cl. ..... 399/96

(58) Field of Classification Search ..... 399/96
See application file for complete search history.

(56) References Cited

FOREIGN PATENT DOCUMENTS

JP 08030048 A * 2/1996
JP 10232591 A * 9/1998
JP 2004-061580 A 2/2004

* cited by examiner

*Primary Examiner*—Quana M Grainger
(74) *Attorney, Agent, or Firm*—Canon U.S.A., Inc. I.P. Division

(57) ABSTRACT

A temperature control device includes a first heat source, a second heat source configured to heat a controlled object subjected to temperature control, a first temperature detector configured to detect a temperature of heat from the first heat source, a second temperature detector configured to detect a temperature of the controlled object, a heat transfer member configured to transfer heat produced by the first heat source to the controlled object, a heat-transfer-amount changing unit configured to change the amount of heat transferred to the controlled object by the heat transfer member, and a controller configured to control a transfer state of the heat-transfer-amount changing unit on the basis of an output from the first temperature detector and an output from the second temperature detector.

9 Claims, 5 Drawing Sheets

TEMPERATURE CONTROL DEVICE AND IMAGE FORMING APPARATUS

BACKGROUND OF THE INVENTION

1. Field of the Invention

The present invention relates to a temperature control device that controls the temperature of a heated object with a heat transfer member for transferring heat from a heat source, and to an image forming apparatus including the temperature control device.

2. Description of the Related Art

There is an increasing demand for energy saving. In image forming apparatuses, including a heating-type fixing device such as a copying machine and a printer, it is most effective to utilize waste heat from the fixing device. Various techniques of utilizing waste heat from the fixing device have been proposed.

As one technique, Japanese Patent Laid-Open No. 2004-061580 discloses that waste heat from a fixing device is transferred by a heat pipe having excellent heat transfer performance so as to warm sheets stored in a sheet feeding device.

Unfortunately, the above-described technique has some disadvantages. In consideration of turn-off of the fixing device, a heater for warming sheets in the sheet feeding device is provided. In this case, the fixing device is driven and heated, and heat is transferred from the fixing device to the sheet feeding device. However, when heating of the fixing device is stopped, the temperature of the fixing device gradually falls, and sometimes falls below the temperature in the sheet feeding device. In this case, heat is transferred from a higher-temperature portion to a lower-temperature portion in the structure using the heat pipe, that is, heat is transferred from the sheet feeding device to the fixing device. For this reason, the heater for maintaining a fixed temperature of the sheet feeding device heats not only the sheet feeding device, but also the fixing device. Consequently, power consumed by the heater increases as the temperature of the fixing device decreases.

SUMMARY OF THE INVENTION

The present invention provides a temperature control device and an image forming apparatus that solve the above-described problems.

The present invention also provides a temperature control device and an image forming apparatus in which heat from a controlled object subjected to temperature control is prevented from being reversely transferred to a first heat source.

The present invention further provides a temperature control device and an image forming apparatus in which the temperature of a controlled object is controlled without vainly consuming power.

A temperature control device according to an aspect of the present invention includes a first heat source; a second heat source configured to heat a controlled object subjected to temperature control; a first temperature detector configured to detect a temperature of heat from the first heat source; a second temperature detector configured to detect a temperature of the controlled object; a heat transfer member configured to transfer heat produced by the first heat source to the controlled object; a heat-transfer-amount changing unit configured to change the amount of heat transferred to the controlled object by the heat transfer member; and a controller configured to control a transfer state of the heat-transfer-amount changing unit on the basis of an output from the first temperature detector and an output from the second temperature detector.

Further features and aspects of the present invention will become apparent from the following description of exemplary embodiments with reference to the attached drawings.

BRIEF DESCRIPTION OF THE DRAWINGS

FIG. 6A is a view of FIG. 2 as seen from a right-hand perspective, while

DESCRIPTION OF THE EMBODIMENTS

Various embodiments, features and aspects of the invention will be described in detail below with reference to the drawings.

Figure 1:
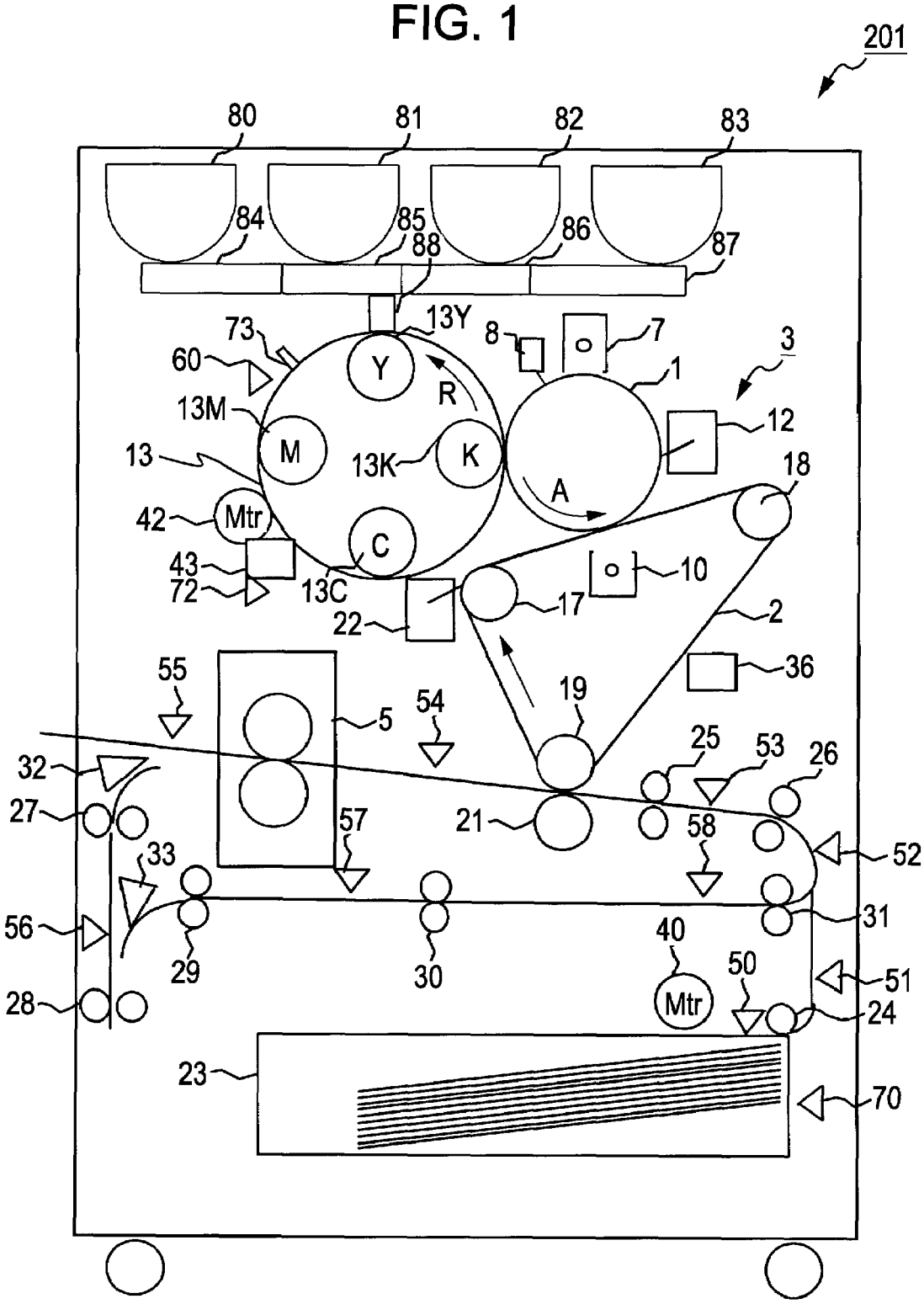
FIG. 1 is a cross-sectional view showing an example configuration of a full-color printer.

FIG. 1 is a cross-sectional view showing an example configuration of a full-color printer 201 serving as an image forming apparatus according to an embodiment of the present invention.

A photosensitive drum (hereinafter referred to as a "photosensitive member") 1 is provided as an image bearing member in an image forming section 3 of the full-color printer 201. The photosensitive member 1 is rotated by a motor (not shown) in the direction shown by arrow A in the figure. As will be described below, a heater is provided in the photosensitive member 1, and controls the temperature of the photosensitive member 1. A primary charger 7, an exposure device 8, a rotary developing unit 13, a transfer device 10, and a cleaner device 12 are arranged around the photosensitive member 1. The photosensitive member 1 corresponds to the controlled object whose temperature is controlled.

Developing devices 13Y, 13M, 13C, and 13K corresponding to four colors are provided in the rotary developing unit 13 so as to form a full-color developed image. The rotary developing unit 13 is rotated by a driving motor 42 formed of a stepping motor. A solenoid 43 operates a lock mechanism for positioning and fixing the rotary developing unit 13. A lock detection sensor 72 formed of a photointerrupter detects the operation of the lock mechanism. A position detecting flag 73 is mounted on the rotary developing unit 13. A rotary-developing-unit HP sensor 60 detects the position detection flag 73, and thereby detects the position of the rotary developing unit 13.

The developing devices 13Y, 13M, 13C, and 13K respectively develop latent images on the photosensitive member 1 with Y, M, C, and K toners. During development, the rotary developing unit 13 is rotated by the motor 42 in the direction shown by arrow R. By detecting the position detection flag 73 mounted on the rotary developing unit 13 by the rotary-developing-unit HP sensor 60, the reference position of the rotary developing member 13 is detected. Then, the rotary developing member 13 is rotated to predetermined positions so that the corresponding developing devices are brought into contact with the photosensitive member 1.

Four color toner images formed on the photosensitive member 1 by development are sequentially transferred onto a belt 2 serving as an intermediate transfer member by the transfer device 10, and the toner images are superimposed thereby. The belt 2 is wound around rollers 17, 18, and 19. Among these rollers, the roller 17 is connected to a driving source (not shown), and functions as a driving roller for driving the belt 2. The roller 18 functions as a tension roller for adjusting the tension of the belt 2. The roller 19 functions as a backup roller for a transfer roller 21 serving as a secondary transfer device (hereinafter referred to as a secondary transfer device 21).

A belt cleaner 22 opposes the roller 17 with the belt 2 disposed therebetween, and is movable into contact with and away from the belt 2. Toner remaining on the belt 2 after secondary transfer is scraped off by a cleaner blade of the belt cleaner 22.

Recording sheets stored in a recording-sheet cassette 23 are lifted into contact with a pickup roller 24 by the operation of a lifter motor 40. One of the recording sheets is drawn from the recording-sheet cassette 23 into a feeding path by the pickup roller 24, and is transported to a nip, that is, a contact portion between the secondary transfer device 21 and the belt 2 by use of pairs of rollers 25 and 26. The toner image formed on the belt 2 is transferred onto the recording sheet at this nip, is thermally fixed by a fixing device 5 (corresponding to the first heat source), and is ejected out of the image forming apparatus 201. In a double-sided image forming operation, a flapper 32 is moved so that the recording sheet can be transported toward feeding rollers 27. After the recording sheet is transported by feeding rollers 28 until the rear edge thereof passes through a flapper 33, the feeding rollers 28 are reversed, and the flapper 33 is moved so that the recording sheet can be transported toward feeding rollers 29. Then, the recording sheet is transported by feeding rollers 30 and 31, and is put again into the feeding path extending from the recording-sheet cassette 23. This allows image formation on a surface of the recording sheet opposite to the surface on which the image has been formed.

In the full-color printer 201 having the above-described configuration, an image is formed in the following manner. First, the surface of the photosensitive member 1 is uniformly and negatively charged with a predetermined charger potential by applying a voltage to the primary charger 7. Then, an image section on the charged photosensitive member 1 is exposed to have a predetermined exposure potential by the exposure device 8 formed of a laser scanner, thereby forming a latent image. The exposure device 8 forms a latent image corresponding to an image on the photosensitive member 1 by controlling execution of the exposure operation according to image signals generated by an image controller (not shown).

An image forming timing of the full-color printer 201 is controlled with reference to a signal ITOP indicating a predetermined position on the belt 2. The belt 2 is wound around the driving roller 17, the tension roller 18, and the backup roller 19, and a predetermined tension is applied to the belt 2 by the tension roller 18. A reflective position sensor 36 for detecting the reference position is provided between the tension roller 18 and the backup roller 19.

Developing biases preset corresponding to the colors are applied to developing rollers of the developing devices 13Y, 13M, 13C, and 13K. A latent image on the photosensitive member 1 is developed with toner while passing through the developing roller, and is visualized as a toner image. The toner image is transferred onto the belt 2 by the transfer device 10, is further transferred onto the recording sheet by the secondary transfer device 21, and is conveyed to the fixing device 5. During full-color printing, four color toner images are superimposed on the belt 2, and is then transferred onto the recording sheet. Residual toner on the photosensitive member 1 is removed and collected by the cleaner device 12. Subsequently, the photosensitive member 1 is uniformly discharged to approximately 0 V by a discharger (not shown) so as to be ready for the next image forming cycle.

A sheets-height sensor 50 detects position of upper sheet of the recording sheets bundle in the recording-sheet cassette 23. Feeding sensors 51 to 58 are provided on the feeding path, and detect the presence of the recording sheet at points where the sensors are provided, or the feeding timing of the recording sheet. A cassette loading sensor 70 detects whether the recording-sheet cassette 23 is loaded.

Containers 80, 81, 82, and 83 store toner to be supplied to the developing devices 13Y, 13M, 13C, and 13K when the amount of toner in the developing devices is reduced. Color toner is supplied to the developing device, which reaches a toner supply path 88 (13Y in FIG. 1), through the corresponding toner supply path 84, 85, 86, or 87 by a motor (not shown).

Figure 2:
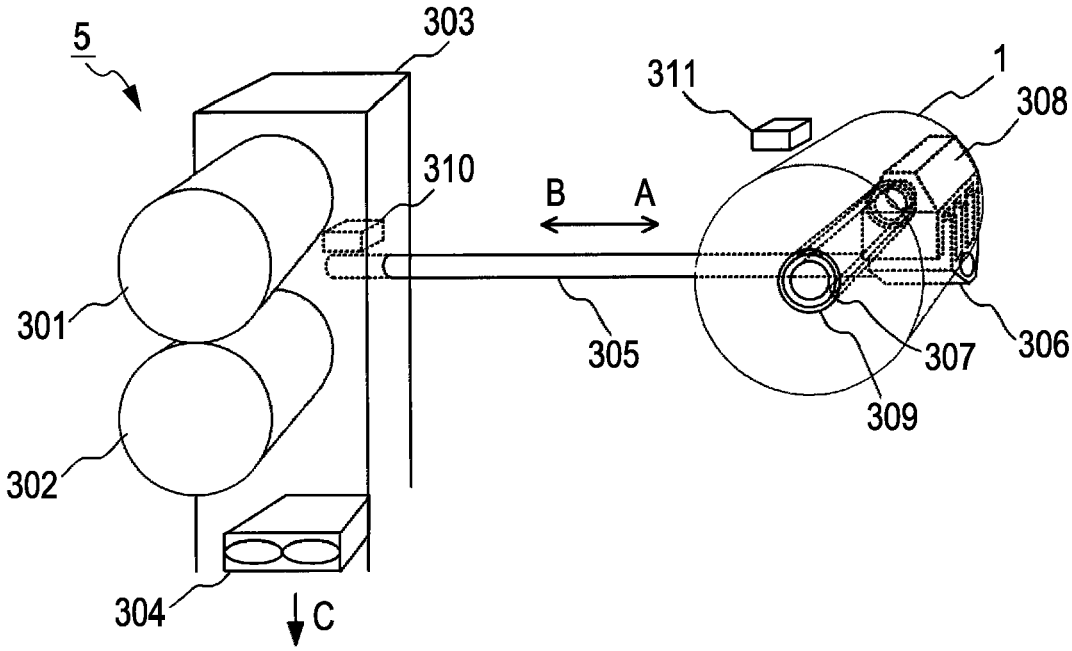
FIG. 2 is a perspective view showing a positional relationship among a photosensitive member, a fixing device, and a heat pipe.

FIG. 2 shows an example relationship among the photosensitive member 1, the fixing device 5, and heat pipes 305 and 307 for transferring waste heat from the fixing device 5 to the photosensitive member 1 in the image forming apparatus 201.

The fixing device 5 includes a fixing roller 301 and a pressure roller 302. Waste heat from the fixing device 5 is transferred to the inner side (back side) of the image forming apparatus 201, passes through a waste heat duct 303, and is then discharged out of the image forming apparatus 201 (in the direction shown by arrow C in the figure) by a fan 304. One end of the heat pipe 305 and a thermo sensor 310 (corresponding to the first temperature detector) for monitoring a temperature of a heat action by the fixing device (the temperature of waste heat) are provided in the waste heat duct 303. A radiation member 306 (corresponding to the heat-transfer-amount changing unit) for transferring heat to the heat pipe 307 is mounted at the other end of the heat pipe 305. The radiation member 306 is disposed adjacent to the photosensitive member 1.

A heat-receiving member 308 (corresponding to the heat-transfer-amount changing unit) for receiving heat radiated from the heat pipe 305 through the radiation member 306 is mounted at one end of the heat pipe 307, and the other end of the heat pipe 307 is embedded in the center of the photosensitive member 1. A heater 309 (corresponding to the second heat source) for adjusting the temperature of the photosensitive member 1 is embedded outside the other end of the heat pipe 307, and is controlled in accordance with the output from a thermo sensor 311 (corresponding to the second temperature detector) that is provided near the photosensitive member 1 so as to detect the temperature of the photosensitive member 1. The heat pipe 305 can be moved by a driving source (stepping motor), which will be described below, in the directions shown by arrows A and B. The movement of the heat pipe 305 is controlled according to a target temperature of the photosensitive member 1 and the temperature of waste heat measured by the thermo sensor 310. The radiation member 306 and the heat-receiving member 308 respectively have fins, and the fins are nested each other. The nested fins overlap, and this allows heat transfer. The amount of transferred heat is changed by changing the area of an overlapping portion between the fins of the radiation member 306 and the heat-receiving member 308 (referred to as the heat transfer area).

Figure 3:
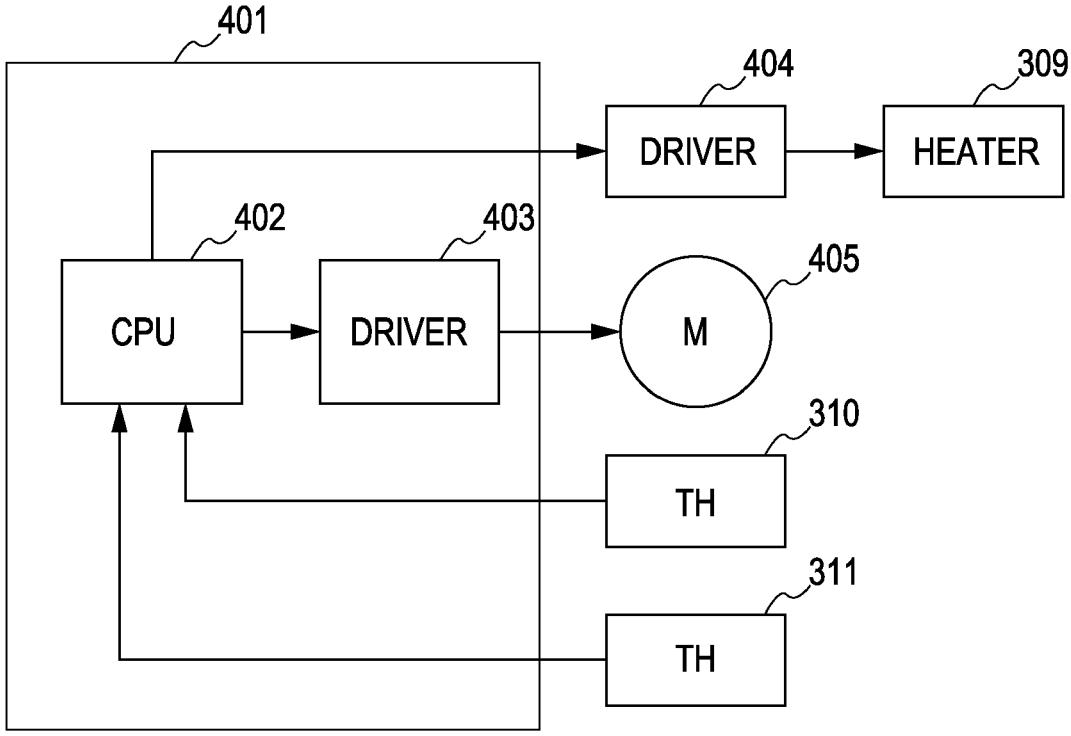
FIG. 3 is a block diagram of an example control system for controlling a motor that drives the heat pipe.

FIG. 3 is a block diagram of a control system for controlling the motor that drives the heat pipe 305 in accordance with the detected temperature of the photosensitive member 1. A CPU 402 for controlling the driving section of the image forming apparatus 201 is mounted on a control board 401. The thermo sensor 310 for detecting the temperature in the waste heat duct 303 and the thermo sensor 311 for detecting the temperature of the photosensitive member 1 are connected to analog/digital (A/D) conversion input terminals of the CPU 402. The CPU 402 converts the output from the thermo sensor 311 into a temperature, and controls a heater driver 404, which controls the current supply to the heater 309, so that the converted temperature is equal to a predetermined target temperature. The CPU 402 further converts the output from the thermo sensor 310 into a temperature, and issues a command to a driver 403, which drives a motor 405 for driving the heat pipe 305, in accordance with the converted temperature and the target temperature of the photosensitive member 1.

When the temperature in the waste heat duct 303 is higher than the target temperature of the photosensitive member 1, the CPU 402 moves the heat pipe 305 to a position such that the radiation member 306 and the heat-receiving member 308 overlap, thereby transferring heat in the waste heat duct 303 to the photosensitive member 1 through the heat pipes 305 and 307. That is, the CPU 402 moves the heat pipe 305 so that the fins of the radiation member 306 and the heat-receiving member 308 are nested. Then, the CPU 402 drives the motor 405 to move the heat pipe 305 in the direction shown by arrow A or B in FIG. 2. When the temperature of the photosensitive member 1 detected by the thermo sensor 311 is higher than the target temperature, the CPU 402 moves the heat pipe 305 in the direction shown by arrow B so as to reduce the heat transfer area between the fins of the radiation member 306 and the heat-receiving member 308. When the temperature of the photosensitive member 1 is lower than the target value, the CPU 402 moves the heat pipe 305 in the direction shown by arrow A so as to increase the heat transfer area.

Figure 4A:
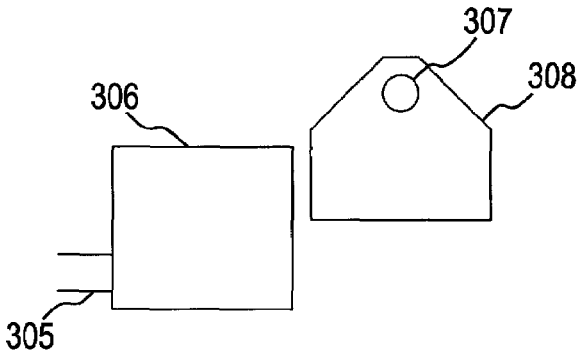
FIGS. 4A, 4B, 4C, and 4D are explanatory views, respectively, showing a state in which a radiation member and a heat-receiving member do not overlap, a state in which the area of an overlapping portion between the radiation member and the heat-receiving member is small, a state in which the area of the overlapping portion is larger than in FIG. 4B, and a state in which the area of the overlapping portion is larger than in FIG. 4C.
Figure 4B:
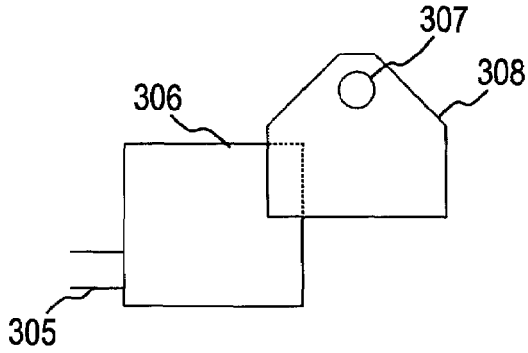
Figure 4C:
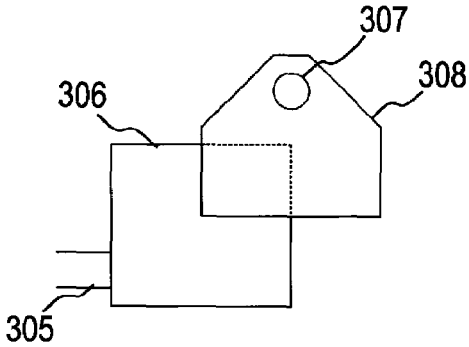
Figure 4D:
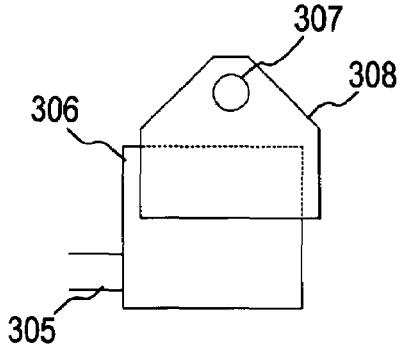

FIGS. 4A, 4B, 4C, and 4D show the changes of the area of the overlapping portion between the radiation member 306 and the heat-receiving member 308 (heat transfer area). FIG. 4A shows a state in which the radiation member 306 does not overlap with the heat-receiving member 308, and FIG. 4B shows a state in which the heat transfer area between the radiation member 306 and the heat-receiving member 308 is small. FIG. 4C shows a state in which the heat transfer area is larger than in FIG. 4B, and FIG. 4D shows a state in which the heat transfer area is larger than in FIG. 4C.

The CPU 402 compares the temperature in the waste heat duct 303 with a target temperature T1 of the photosensitive member 1. When the temperature in the waste heat duct 303 is lower than or equal to the target temperature T1, the state shown in FIG. 4A is brought about. That is, the CPU 402 moves the heat pipe 305 in the direction shown by arrow B in FIG. 2 so that the radiation member 306 mounted on the heat pipe 305 does not overlap with the heat-receiving member 308 mounted on the heat pipe 307. When the temperature in the waste heat duct 303 is higher than the target temperature T1 of the photosensitive member 1, one of the states shown in FIGS. 4B, 4C, and 4D is brought about so that heat in the waste heat duct 303 is transferred to the photosensitive member 1. That is, the heat transfer area between the radiation member 306 and the heat-receiving member 308 is controlled. For example, in a case in which it is determined that the temperature of the photosensitive member 1 is higher than the target temperature T1 when the radiation member 306 and the heat-receiving member 308 are placed in the state shown in FIG. 4C, the heat pipe 305 is moved in the direction shown by arrow B so as to reduce the heat transfer area between the radiation member 306 and the heat-receiving member 308, as shown in FIG. 4B. Conversely, when it is determined that the temperature of the photosensitive member 1 is lower than the target temperature T1, the heat pipe 305 is moved in the direction shown by arrow A so as to increase the heat transfer area, as shown in FIG. 4D.

Figure 5:
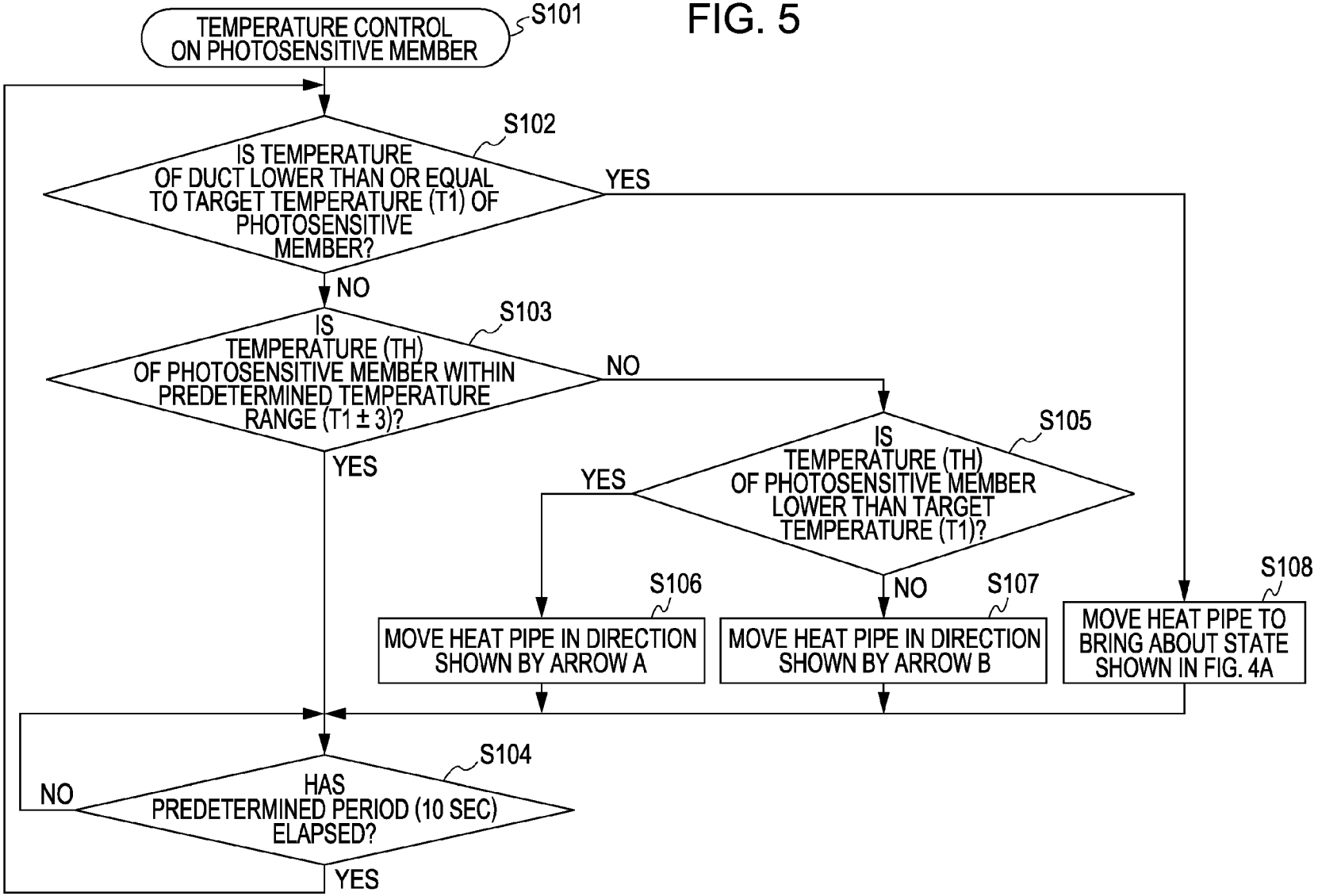
FIG. 5 is a flowchart explaining exemplary temperature control on the photosensitive member.
Figure 6A:
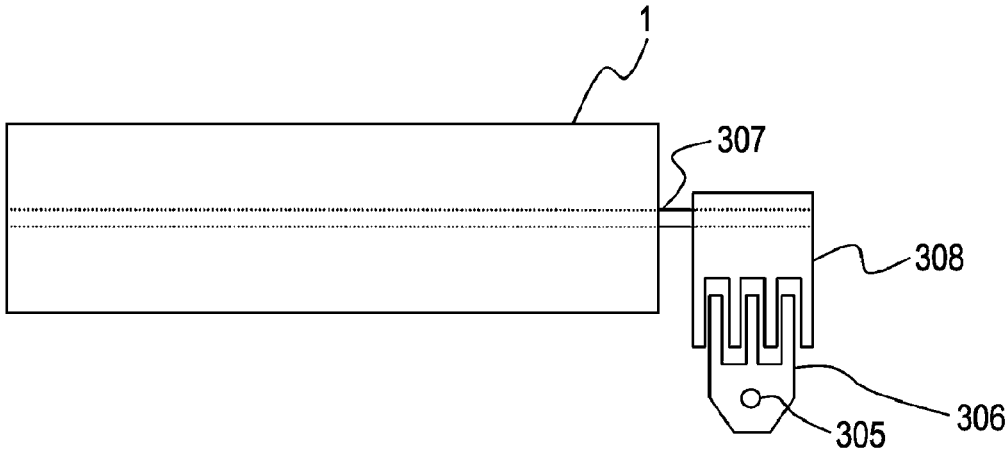
Figure 6B:
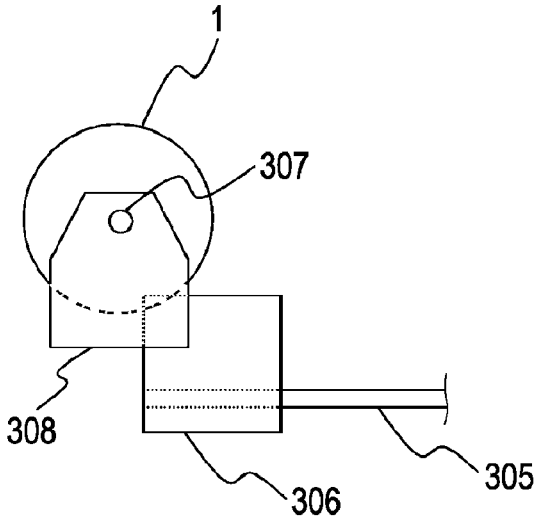
FIG. 6B is a view of FIG. 2 as seen from a backside perspective.

FIG. 5 is a flowchart showing exemplary control exerted by the CPU 402 to control the temperature of the photosensitive member 1 (photosensitive-member temperature control in Step S101).

First, the CPU 402 samples the temperature in the waste heat duct 303 with the thermo sensor 310, and determines whether the sampled temperature is lower than the target temperature T1 of the photosensitive member 1 (Step S102). When the temperature in the waste heat duct 303 is lower than or equal to the target temperature T1, the CPU 402 moves the heat pipe 305 so that the radiation member 306 and the heat-receiving member 308 do not overlap with each other (the state shown in FIG. 4A) (Step S108).

When the temperature in the waste heat duct 303 is higher than the target temperature T1 (NO in Step S102), the CPU 402 controls the temperature of the photosensitive member 1 by using waste heat from the fixing device 5 in Step S103 and subsequent steps.

In particular, the CPU 402 samples the temperature TH of the photosensitive member 1 with the thermo sensor 311, and determines whether the temperature TH is within a predetermined temperature range (e.g., ±3 degrees with reference to the target temperature T1) (Step S103). The temperature range is predetermined because hysteresis is provided so that the motor 405 is not frequently rotated forward and backward. When the temperature TH is within the predetermined temperature range, the CPU 402 performs Step S102 again after a predetermined period (e.g., ten seconds) has elapsed (Step S104).

When the temperature TH is outside the predetermined range in Step S103, the CPU 402 determines whether the temperature TH is lower than the target temperature T1 (Step S105). When the temperature TH is lower than the target temperature T1, the CPU 402 moves the heat pipe 305 by a predetermined amount in the direction of arrow A in FIG. 2 so as to increase the heat transfer area between the radiation member 306 and the heat-receiving member 308 (e.g., the state shown in FIG. 4C is changed to the state shown in FIG. 4D) (Step S106). The moving amount of the heat pipe 305 in one moving operation corresponds to 20% of the largest heat transfer area.

When the temperature TH is higher than the target temperature T1, the CPU 402 moves the heat pipe 305 by the predetermined amount in the direction of arrow B so as to reduce the heat transfer area (for example, the state show in FIG. 4C is changed to the state shown in FIG. 4B) (Step S107). Subsequently, the CPU 402 performs Step S102 again after the predetermined period has elapsed since the previous sampling of the temperature of the photosensitive member 1. The predetermined temperature range, the predetermined moving amount, and the predetermined period described above may be set arbitrarily.

The controlled object subjected to temperature control is not limited to the photosensitive member, and may be a heater for warming the sheets stored in the recording-sheet cassette 23.

As described above, heat for the first heat source is transferred to the controlled object subjected to temperature control by using the heat pipes. When the temperature of the first heat source is lower than or equal to the target temperature of the controlled object, the heat transmission path is cut off. This can prevent heat from being transferred from the controlled object to the first heat source. Further, heat radiated from the second heat source can be minimized by placing the heat-transfer-amount changing unit near the second heat source. This can prevent power from being vainly consumed by the second heat source.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-116593 filed Apr. 20, 2006, which is hereby incorporated by reference herein in its entirety.

What is claimed:

1. A temperature control device comprising:

a first heat source;

a second heat source configured to heat a controlled object subjected to temperature control;

a first temperature detector configured to detect a temperature of heat from the first heat source;

a second temperature detector configured to detect a temperature of the controlled object;

a heat transfer member configured to transfer heat produced by the first heat source to the controlled object;

a heat-transfer-amount changing unit configured to change the amount of heat transferred to the controlled object by the heat transfer member; and a controller configured to control a transfer state of the heat-transfer-amount changing unit on the basis of an output from the first temperature detector and an output from the second temperature detector.

2. The temperature control device according to claim 1, wherein the controller controls the heat-transfer-amount changing unit so that heat transfer is not performed between the first heat source and the controlled object when the temperature detected by the first temperature detector is lower than the temperature detected by the second temperature detector.

3. The temperature control device according to claim 1, wherein the controller controls the heat-transfer-amount changing unit so that heat transfer is performed between the first heat source and the controlled object when the temperature detected by the first temperature detector is higher than the temperature detected by the second temperature detector.

4. The temperature control device according to claim 1, wherein the heat-transfer-amount changing unit includes:

a radiation member configured to radiate the heat transferred by the heat transfer member; and a heat-receiving member configured to receive the heat radiated from the radiation member.

5. The temperature control device according to claim 4, wherein the controller controls the amount of heat transferred from the first heat source to the controlled object by changing a heat transfer area of an overlapping portion between the radiation member and the heat-receiving member.

6. The temperature control device according to claim 5, wherein the controller controls the heat-transfer-amount changing unit so as to decrease the heat transfer area when the temperature detected by the second temperature detector is higher than a target temperature of the controlled object, and so as to increase the heat transfer area when the temperature detected by the second temperature detector is lower than the target temperature of the controlled object.

7. The temperature control device according to claim 5, wherein the radiation member and the heat-receiving member respectively have fins, and the fins are nested with each other, and wherein the controller controls the amount of heat transferred form the first heat source to the controlled object by changing an area of an overlapping portion between the fin of the radiation member and the fin of the heat-receiving member.

8. An image forming apparatus comprising:

an image forming section configured to form an image on a sheet;

a first heat source configured to fix the image formed on the sheet;

a second heat source configured to heat a controlled object subjected to temperature control;

a first temperature detector configured to detect a temperature of heat from the first heat source;

a second temperature detector configured to detect a temperature of the controlled object;

a heat transfer member configured to transfer heat produced by the first heat source to the controlled object;

a heat-transfer-amount changing unit configured to change the amount of heat transferred to the controlled object by the heat transfer member; and a controller that controls a transfer state of the heat-transfer-amount changing unit on the basis of an output from the first temperature detector and an output from the second temperature detector.

9. The image forming apparatus according to claim 8, wherein the controlled object is a photosensitive member, and the second heat source is a heater configured to warm the photosensitive member.

* * * * *